US011257604B2

(12) United States Patent
Choi et al.

(10) Patent No.: US 11,257,604 B2
(45) Date of Patent: Feb. 22, 2022

(54) MULTI-LAYERED RADIO-ISOTOPE FOR ENHANCED PHOTOELECTRON AVALANCHE PROCESS

(71) Applicant: UNITED STATES OF AMERICA AS REPRESENTED BY THE ADMINISTRATOR OF NASA, Washington, DC (US)

(72) Inventors: Sang H. Choi, Poquoson, VA (US); Dennis M. Bushnell, Hampton, VA (US); David R. Komar, Hampton, VA (US); Robert C. Hendricks, Cleveland, OH (US)

(73) Assignee: UNITED STATES OF AMERICA AS REPRESENTED BY THE ADMINISTRATOR OF NASA, Washington, DC (US)

( * ) Notice: Subject to any disclaimer, the term of this patent is extended or adjusted under 35 U.S.C. 154(b) by 316 days.

(21) Appl. No.: 16/426,345

(22) Filed: May 30, 2019

(65) Prior Publication Data

US 2019/0392961 A1 Dec. 26, 2019

Related U.S. Application Data

(60) Provisional application No. 62/678,006, filed on May 30, 2018.

(51) Int. Cl.
*G21H 1/04* (2006.01)
*G21H 1/12* (2006.01)
(Continued)

(52) U.S. Cl.
CPC ..... *G21H 1/04* (2013.01); *G21G 1/12* (2013.01); *G21H 1/103* (2013.01); *G21H 1/12* (2013.01);
(Continued)

(58) Field of Classification Search
CPC ..... G21H 1/04; G21H 1/12; G21H 1/103; G21G 1/12
See application file for complete search history.

(56) References Cited

U.S. PATENT DOCUMENTS 4,497,973 A 2/1985 Heath et al.
10,269,463 B2 4/2019 Choi et al.
(Continued)

OTHER PUBLICATIONS

L. Popa-Simil, I.L. Popa-Simil, "Nano Hetero Nuclear Fuel Structure," NSTI-Nanotech, 2007, vol. 1, LAVM LLC, Los Alamos, NM 87544, pp. 344-347.
(Continued)

*Primary Examiner* — Jayne L Mershon
(74) *Attorney, Agent, or Firm* — M. Bruce Harper; Jonathan B. Soike; Helen M. Galus

(57) ABSTRACT

The present disclosure is directed to a nuclear thermionic avalanche cell (NTAC) systems and related methods of generating energy comprising a radioisotope core, a plurality of thin-layered radioisotope sources configured to emit high energy beta particles and high energy photons, and a plurality of NTAC layers integrated with the radioisotope core and the radioisotope sources, wherein the plurality of NTAC layers are configured to receive the beta particles and the photons from the radioisotope core and sources, and by the received beta particles and photons, free up electrons in an avalanche process from deep and intra bands of an atom to output a high density avalanche cell thermal energy through a photo-ionic or thermionic process of the freed up electrons.

11 Claims, 9 Drawing Sheets

(51) Int. Cl.

| | |
|---|---|
| ***G21G 1/12*** | (2006.01) |
| ***G21H 1/10*** | (2006.01) |
| ***G21H 3/00*** | (2006.01) |
| *G21G 1/00* | (2006.01) |

(52) U.S. Cl.
CPC ..... *G21H 3/00* (2013.01); *G21G 2001/0068* (2013.01); *G21G 2001/0094* (2013.01)

(56) References Cited

U.S. PATENT DOCUMENTS

| | | | | |
|---|---|---|---|---|
| 2008/0272680 | A1 | 11/2008 | Perreault | |
| 2013/0125963 | A1 | 5/2013 | Binderbauer et al. | |
| 2015/0188019 | A1 | 7/2015 | Corrado | |
| 2016/0225476 | A1* | 8/2016 | Choi ..... | G21H 1/106 |
| 2017/0288113 | A1 | 10/2017 | Choi et al. | |
| 2018/0350481 | A1 | 12/2018 | Choi et al. | |

OTHER PUBLICATIONS

Narducci, D., "Do we really need high thermoelectric figures of merit? A critical appraisal to the power conversion efficiency of thermoelectric materials," Appl. Phys. Lett., 2011, pp. 17-20, 99(10).
Stordeur, M. et al., "Low power thermoelectric generator—self-sufficient energy supply for micro systems," 16th Int. Conf. Thermoelectr., 1997, pp. 575-577.
National Aeronautics and Space Administration., "Radioisotope power systems: radioisotope thermoelectric generator (RTG)," 2013, <https://solarsystem.nasa.gov/rps/rlg.cfm> (Jan. 6, 2017).
Koelle, D. et al., "Development and transportation costs of space launch systems." Proc. DGLR/CEAS Eur. Air Sp. Conf. (2007).
Swanson, R. M., "A proposed thermophotovoltaic solar energy conversion system," Proc. IEEE, 1979, pp. 446-447, 67(3).
Schock, A. et al., "Design, analysis, and optimization of a radioisotope thermophotovoltaic (RTPV) generator, and its applicability to an illustrative space mission," Acta Astronaut. 37(C), 1995, pp. 21-57.
Ferrari, C. et al., "Overview and status of thermophotovoltaic systems," Energy Procedia 45, 2014, pp. 160-169.
Bermel, P. et al., "Design and global optimization of high-efficiency thermophotovoltaic systems.," Opt. Express 18 Suppl, 2010, pp. A314-A334, 3(103).
Nelson, R. E., "A brief history of thermophotovoltaic." Semicond. Sci. Technol. 2003. pp. S141-S143, 18.
Crowley, C. J. et al., "Thermophotovoltaic converter performance for radioisotope power systems," AIP Conf. Proc. 2005, 746, pp. 601-614.
Coutts, T. J. "Overview of thermophotovoltaic generation of electricity," Sol. Energy Mater. Sol. Cells, 2001, pp. 443-452, 66(1-4).
Murray, C. S. et al., "Thermophotovoltaic converter design for radioisotope power systems," AIP Conf. Proc. Thermophotovoltaic Gener. Electr. 6th Conf., 2004, pp. 123-132.
Molesky, S. et al., "Ideal near-field thermophotovoltaic cells," Phys. Rev. B, 2015, pp. 1-7, 91(20).
Sulima, O.V. et al., "Fabrication and simulation of GaSb thermophotovoltaic cells," Sol. Energy Mater. Sol. Cells, 2001, pp. 533-540, 66(1-4).
Coutts, T. J., "Review of progress in thermophotovoltaic generation of electricity." Renew. Sustain. energy Rev. 1999, pp. 77-184, 3(2).
Shakouri, A., "Thermoelectric , thermionic and thermophotovoltaic energy conversion J Q (r) q Report Documentation Page", 2005, pp. 1-6.
Rosaire, C. G. et al., "Radioisotope thermophotovoltaic batteries for universal low power systems," Nucl. Emerg. Technol. Space, NETS, 2013, pp. 419-427.
Cheetham, K. J. et al., "Low bandgap GaInAsSbP pentanary thermophotovoltaic diodes," Sol. Energy Mater. Sol. Cells, 2011, pp. 534-537, 95(2).
Nagpal, P. et al., "Efficient low-temperature thermophotovoltaic emitters from metallic photonic crystals," Nano Lett., 2008, pp. 3238-3243, 8(10).
Durisch, W. et al., "Novel thin film thermophotovoltaic system," Sol. Energy Mater. Sol. Cells, 2010, pp. 960-965, 94(6).
Schock, A. et al., "Design and integration of small RTPV generators with new millennium spacecraft for outer solar system," Acta Astronaut, 1997, pp. 801-816, 41(12).
Gerstenmaier, Y. C. et al., "Efficiency of termionic and thermoelectric converters," AIP Conf. Proc., 2007, pp. 37-46, 890.
Oman, H. "Deep space travel energy sources," IEEE Aerosp. Electron. Syst. Mag., 2003, 18(2), pp. 28-35.
Humphrey, T. E. et al., "Power optimization in thermionic devices," J. Phys. D. Appl. Phys., 2005, pp. 2051-2054, 38(12).
Trucchi, D. M. et al., "Thermionic Emission□: A Different Path to Solar Thermal Electricity." SolarPaces Conf. (2012).
Schwede, J. W. et al., "Photon-enhanced thermionic emission for solar concentrator systems," Nat. Mater., 2010, pp. 762-767, 9(9),Nature Publishing Group.
Adams, S. F., "Solar thermionic space power technology testing: A historical perspective." AIP Conf. Proc., 2006, pp. 590-597, 813.
Ha, C. T. et al., "Advanced Stirling radioisotope generator: Design processes, reliability analyses impacts, and extended operation tests," AIP Conf. Proc., 2008, pp. 458-465, 969.
Chan, J. et al., "Development of advanced Stirling Radioisotope Generator for space exploration," AIP Conf. Proc. , May 2007, pp. 615-823, 880.
Wong, W. A. et al., "Advanced Stirling convertor ( ASC )—from technology development to future flight product," 2008, pp. 1-26.
Cockfield, R. D. et al., "Stirling radioisotope generator for mars surface and deep space missions," 2002 37th Intersoc. Energy Convers. Eng. Conf., 2002, pp. 134-139.
Shaltens, R. K. et al., "Advanced Stirling technology development at NASA Glenn Research Center," NASA Sci. Technol. Conf.(Sep. 2007).
Oriti, S. M., "Advanced Stirling Radioisotope Generator Engineering Unit 2 (ASRG EU2 ) final assembly" (2015).
Mason., L. S. et al., "Modular sliding radioisotope generator," 13th Int. Energy Convers. Eng. Conf., 2015, 3809.
Chan, T. S., "System-level testing of the advanced Stirling radioisotope generator engineering hardware," 12th Int. Energy Convers. Eng. Conf. (2014).
Chan, J. et al., "Advanced Stirling radioisotope generator emergency heat dump test for nuclear safety consideration," 9th Annu. Int. Energy Convers. Eng. Conf. IECEC 2011 (2011).
Leonov, V el al., "Wearable thermoelectric generators for body-powered devices," J. Electron. Mater., 2009, pp. 1491-1498, 38(7).
Leonov, V et al., "Thermoelectric and hybrid generators in wearable devices and clothes." Proc.—6th Int. Work. Wearable Implant. Body Sens. Networks, 2009, pp. 95-200.
Wang Z. L. et al., "Realization of a wearable miniaturized thermoelectric generator for human body applications," Sensors Actuators, A Phys. 2009, pp. 95-102, 156(1).
Leonov, V, "Thermoelectric energy harvesting of human body heat for wearable sensors," IEEE Sens. J., 2013, pp. 2284-2291, 13(6).
Kim, M. K. et al., "Wearable thermoelectric generator for human clothing applications," 2013 Transducers Eurosensors XXVII 17th Int. Conf. Solid-State Sensors, Actuators MicrosystemsJun. 2013, pp. 1376-1379.
He, W. et al., "Recent development and application of thermoelectric generator and cooler," Appl. Energy, 2015, pp. 1-25, 143.
Bahk, J. H. et al., "Flexible thermoelectric materials and device optimization for wearable energy harvesting," J. Mater Chem. C 3, 2015, pp. 10362-10374.
Sebald, G. et al., "On thermoelectric and pyroelectric energy harvesting," Smart Mater. Struct. 2009,18(12), p. 25006, pp. 1-7.
Miotla, D., "Assessment of plutonium-238 production alternatives," Apr. 21, 2008 (available at http://energy.gov/sites/prod/files/NEGTN0NEAC_PU-238_042108.pdf), downloaded on Oct. 4, 2018.
National Aeronautics and Space Administration., "What is plutonium-238□?," <https://solarsystem.nasa.gov/rps/docs/APP RPS Pu-238 FS 12-10-12.pdf> (Jan. 25, 2016), downloaded on Oct. 4, 2018.

(56) References Cited

OTHER PUBLICATIONS

Howe, S. D. et al., "Economical production of Pu-238." Nucl. Emerg. Technol. Sp. (NETS 2013) 2013, pp. 1-12, 238.
Wall, M., "Full-Scale Production of Plutonium Spacecraft Fuel Still Years Away," Space.com, May 17, 2016, (available at http://www.space.com/32890-nuclear-fuel-spacecraft-production-plutonium-238.html), downloaded on Oct. 4, 2018.
Griggs, M. B., "Plutonium-238 is produced in America for the first time in almost 30 Years," Pop. Sci., Dec. 23, 2015 (available at http://www.popsci.com/plutonium-238-is-produced-in-america-for-first-time-in-30-years), downloaded on Oct. 4, 2018.
Szondy, D., "US restarts production of plutonium-238 to power space missions," New Atlas, Dec. 23, 2015 (available at http://newatlas.com/oml-plutonium-238-production-space/41041/). downloaded on Oct. 4, 2018.

* cited by examiner

MULTI-LAYERED RADIO-ISOTOPE FOR ENHANCED PHOTOELECTRON AVALANCHE PROCESS

CROSS-REFERENCE TO RELATED PATENT APPLICATION(S)

This patent application claims the benefit of and priority to U.S. Provisional Patent Application No. 62/678,006, filed on May 30, 2018, the contents of which are hereby incorporated by reference in their entirety.

STATEMENT REGARDING FEDERALLY SPONSORED RESEARCH OR DEVELOPMENT

The invention described herein was made by employees of the United States Government and may be manufactured and used by or for the Government of the United States of America for governmental purposes without the payment of any royalties thereon or therefore.

OVERVIEW

Conventional nuclear batteries, nuclear capacitors, or similar nuclear power generation systems rely upon nuclear fission induced by the collision of two subatomic particles. Generally, a subatomic particle, typically a neutron, is absorbed by the nucleus of a fissile material that fissions into two lighter elements and additional neutrons along with a release of energy. The fissile material in some cases can be a material such as uranium-235. Conventional systems, however, fail to capture the energy of other particles released during fission. The current disclosure describes methods and systems for the effective absorption or capture of isotope-emitted beta particles and high energy photons to maximize the power output. The methods and systems disclosed herein result in a more efficient means to produce power as effective absorption or capture of these high energy subatomic particles and high energy photons determines the power density of energy conversion systems.

Previous energy systems include nuclear batteries described in U.S. Pat. No. 10,269,463, hereby incorporated by reference in its entirety. Methods and systems disclosed herein improve the energy conversion, production, and efficiency of Nuclear Thermionic Avalanche Cell (NTAC) related systems. Previous energy systems using a NTAC are described in U.S. Pat. No. 10,269,463, the contents of which are hereby incorporated by reference in their entirety. The novel configuration and design of the NTAC disclosed herein takes advantage of an isotope's multiple internal interactions via a uniquely designed multiple layered structure of the NTAC. The unique design disclosed herein results in an energy conversion and power generation system with extremely high energy density output. The systems and methods disclosed herein would only require refueling every three to four decades (depending on the application) or perhaps longer. Such functionality could be attractive in applications where the energy-using device is very remote from energy refueling sources or where there are operational benefits associated with minimal refueling. Potential applications include use in drones, high altitude aircraft, public utility-scale electric power generation facilities, electric propulsion for automobiles and airplanes, power for remote and rural communities, nodal power without transmission lines, marine electric-propulsion onboard nautical vessels, spacecraft, and satellites.

BRIEF SUMMARY

The present disclosure is directed to a nuclear thermionic avalanche cell (NTAC) system comprising a radioisotope core, a plurality of thin-layered radioisotope sources configured to emit high energy beta particles and high energy photons, and a plurality of NTAC layers integrated with the radioisotope core and the radioisotope sources, wherein the plurality of NTAC layers are configured to receive the beta particles and the photons from the radioisotope core and sources, and by the received beta particles and photons free up electrons in an avalanche process from deep and intra bands of an atom to output a high density avalanche cell thermal energy through a photo-ionic process which is similar to a thermionic process of the freed up electrons but induced by photons. In some embodiments, the beta particles are electrons or positrons. In embodiments, the photons are x-rays, gamma rays, or visible UV light. In some embodiments, the radioisotope core and the thin-layered radioisotope sources may be Cobalt-60 or Sodium-22 or Cesium-137. In still other embodiments, the radioisotope may be nuclear waste or nuclear fuel. In some embodiments, the radioisotope core, the radioisotope sources, and the NTAC layers further comprise a thin emitter layer configured to capture the high energy beta particles and/or the high energy photons released from the radioisotope core and radioisotope sources. In some embodiments, the thin emitter layer comprises nanostructured surface of a high Z material (e.g., atomic number greater than 53). In some embodiments, a plurality of collectors are positioned between the NTAC layers, and the radioisotope core and sources wrapped with the thin emitter layer, and the plurality of collectors are configured to capture the high energy beta particles and/or the high energy photons emitted from the thin emitter layer. In yet other embodiments, the collectors comprise a low Z material (e.g., atomic number less than or equal to 20) or mid Z material (e.g., atomic number 21-53). In some implementations, the thin-layered radioisotope sources may have a thickness of millimeter (mm) scale, or may have a thickness of at least 3 to 5 mm. In another implementation, a thermoelectric generator may be configured to receive and convert the thermal waste energy from NTAC for additional output power to the high density avalanche cell power/thermal energy.

Another embodiment disclosed is a method of capturing high energy photons to generate power comprising, receiving high energy beta particles and high energy photons emitted from a radioisotope core and a plurality of thin-layered radioisotope sources integrated with a nuclear thermionic avalanche cell (NTAC), wherein the NTAC comprises a plurality of NTAC layers configured to receive the beta particles and the photons, outputting avalanche electrons using the received beta particles and high energy photons, guiding the avalanche electrons to cross over a vacuum gap to a collector, harnessing and running the electrons at the collector via a power circuit, and generating an electrical current. In some implementations, the radioisotope core, the thin-layered radioisotope sources, and the NTAC layers further comprise a thin emitter layer comprising a nanostructured surface of a high Z material.

Yet another embodiment disclosed is an energy conversion system comprising a radioisotope core, a plurality of thin-layered radioisotope sources configured to emit high energy beta particles and/or high energy photons, wherein the thin-layered radioisotope sources have a thickness from about 3 mm to about 5 mm, wherein the radioisotope core and the layered isotope sources comprise Cobolt-60 and/or Sodium-22, and/or Cesium-137, and a nuclear thermionic avalanche cell (NTAC) comprising a plurality of NTAC layers integrated with the radioisotope core and the radioisotope sources and configured to receive the beta particles and the photons from the radioisotope sources and, by the received beta particles and photons, free up electrons in an avalanche process from deep and intra bands of an atom to output a high density avalanche cell thermal energy through a photo-ionic emission process of the freed up electrons, wherein the NTAC layers comprise emitters with nanostructured surface of a high Z material and collectors of a mid Z material that sandwich the layer of electrical insulator, and a thermoelectric generator configured to receive and convert the waste thermal energy from NTAC system into additional output power, and wherein the waste thermal energy of NTAC is conductively transferred through the NTAC layers of emitter and collector, the radioisotope core, and the thin-layered radioisotope sources to the thermoelectric generators located at the top and bottom and surrounding of NTAC.

These and other features, advantages, and objects of the present invention will be further understood and appreciated by those skilled in the art by reference to the following specification, claims, and appended drawings.

DETAILED DESCRIPTION

Figure 1:
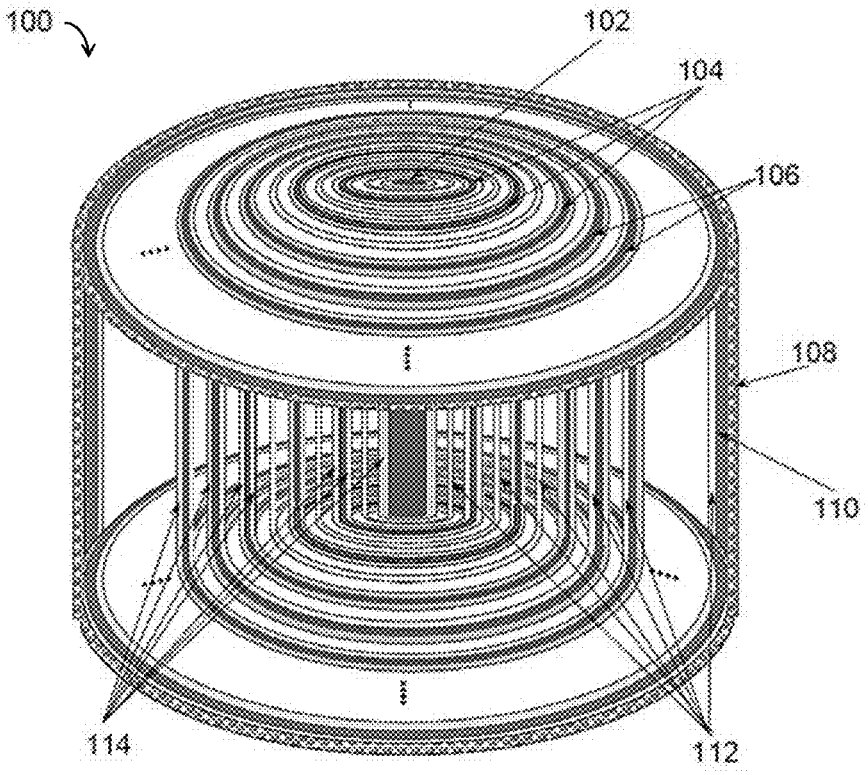
FIG. 1 depicts an NTAC device with distributed thin radioisotope layers, in accordance with one or more embodiments of the present disclosure.

For purposes of description herein, the terms "upper," "lower," "right," "left," "rear," "front," "vertical," "horizontal," and derivatives thereof shall relate to the depicted embodiment as oriented in FIG. 1. However, it is to be understood that embodiments may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The systems and methods disclosed herein relate to excessive heat generated while radioactive material decays that may be used for a thermoelectric generator. The waste thermal energy from a nuclear thermionic avalanche cell (NTAC) is transferred to a thermoelectric generator to produce electricity. Such an energy source is known to be useful for terrestrial and space applications. Conventional nuclear thermionic avalanche cells typically include a single type of emitter material with a reasonable thickness to capture high energy photons. Liberated electrons used in the NTAC's avalanche process to output a high density avalanche cell thermal energy/power through a thermionic process using the liberated electrons lacks efficiency. The liberated electrons within the emitter material may undergo multiple scattering that causes a loss of the electron's kinetic energy by the Coulomb collisions with neighboring electrons or recombination process through a free-to-bound transition. Accordingly, a new design concept of multi-thin-layers of isotope integrated with multi-NTAC layers is disclosed herein to eliminate these problematic electron interactions.

A combination of distributed thin radioisotope layers and multi-NTAC layers gives rise to several advantageous features to include more distributed emissions of high energy photons and high energy beta particles from a number of thin isotope layers that reduces the coupling probability within inter-atomic structure of isotope source material, capture and conversion of the most of high energy photons and/or beta particles by multi-NTAC layers without leakage of residual radiation, thus requiring minimal radiation protection, effective emission of avalanche electrons from the combined structure of thin layered radiation source and emitters into vacuum gap by reducing internal scattering within atomic structure of isotope source and emitter materials, essentializing the high order interactions within inter-atomic structure of thinly layered isotope itself and emitters of NTAC for liberating more energetic electrons, and making a distributed thermal load on each layer.

Conventional direct energy conversion systems have intrinsic limits to generate a number of useful electrons, such as a limit of up to 3 Coulomb/$cm^3$ ("C/$cm^3$") only for power conversion, because these systems are only able to tap a maximum of one to four electrons in the valence band. Accordingly, the overall energy densities of the conventional conversion systems are intrinsically poor and low. NTAC systems and devices, however, use a relatively large number of deep and intra band (of inner-shell) electrons to generate up to $10^5$ C/$cm^3$ through the bound-to-free quantum level transitions of deep and intra band (of inner shell) electrons and the reordering process of a shaken nucleus under the impacts of ultrahigh energy multi-photons, such as X-rays, gamma rays (i.e., y-rays), and—as discussed in the present disclosure—emitted beta particles. These phenomena are inversely well-explained by the emission spectra of X-rays, gamma rays, and beta particles when the intra-band electrons are shaken and undergo a population inversion process of quantum level transitions. The NTAC concept uses a heavy collection of freed-up energetic electrons, such as $10^3$-$10^5$ C/$cm^3$, for power generation through thermionic processes. The freed-up electrons are highly energetic such that only thermionic processes can maximize their transmission across a vacuum-gap in an NTAC device. Since this huge number of free electrons obtained through X-ray, gamma ray, or beta particle driven quantum transition is directly pushed off and across the vacuum-gap and utilized for power generation using photo-ionic (or similarly thermionic) process, the disclosed NTAC systems may result in an ultrahigh power density, such as power density greater than 1 $kW/cm^3$.

FIG. 1 illustrates a new way to capitalize thin multi-layered isotope for the enhancement of electron liberation through higher order interactions in NTAC devices. The multi-layered NTAC device 100 may typically include a radioisotope core 102 surrounded by thin radioisotope layers 104. In some implementations, the radioisotope or fuel may be Cobalt-60, Sodium-22, Cesium-137, nuclear waste, recycled nuclear waste, or other suitable nuclear fuel. The radioisotope core 102 and thin layers 104 may include insulators 106, collector electrodes 112, and emitter electrodes 114. The walls and the top and bottom caps of the new NTAC device 100 may have radiation shielding layers 110 and metallic junction thermoelectric layer 108 encapsulating the device 100. The isotope core 102 and isotope thin layers 104 and emitters 114 of the NTAC 100 have a tendency to scatter and absorb its own emitted radiation and/or beta particles. Such scattering and absorption of high energy photons and beta particles through its own body reduce the intensity of emission spectra. The reduced portion of emission spectra by scattering and absorption turns out as a liberated electrons, including Auger electrons, X-ray fluorescence, and thermal energy. If the radiation isotope materials and emitter materials are too thick, the scattering and absorption of emitted y-rays and high energy beta particles within the isotope and emitter materials become dominant and spread the original intensity of emission spectra into the emissions of lower energetic electrons (Compton edge electrons and Auger electrons), X-ray fluorescence, and increased thermal loading. The new configuration of NTAC as shown in FIG. 1 offers a great improvement in performance by adopting a distributed thin multi-layer radioisotope sources 102 and 104 and emitters 114 that reduce thermal loading due to multiple scattering of high energy photons and/or energetic beta particles in higher order interactions.

The internal thermal loading by scattering and absorption becomes more significant when the decay process of the radioisotope material creates very high energy photons and/or high energy beta particles and the body mass increases. Such a photon and/or a beta particle initially interacts with the intra-band electrons and nucleus of atom to generate a number of energetic electrons, y-rays remainder, and X-ray fluorescence by energy and momentum splitting. These energetic electrons, y-rays remainder, and X-ray fluorescence from the primary interaction undergo the secondary mode of interaction with neighboring atoms to populate further liberated electrons, but at the same time increase thermal loading if material scattering thickness is too thick.

Such phenomena is described by photoelectric (pe), photonuclear (pn), Compton scattering (Cs), and electron/positron pair production (pp). A huge number of electrons in the intra-band of atom can be liberated through a bound-to-free transition when coupled with either high energy photons or high energy beta particles or both together. In the pe process, an electron coupled and liberated by incident high energy photon or by energetic beta particle gains a portion of photon energy or beta particle energy. In such a case, the portion of energy gained by a liberated electron is substantially high up to several hundreds of keV level. This electron is energetic and may have an increased collision probability as a sequential Coulomb collision to the shell electrons of neighboring atom as the secondary interaction. The liberated emission of energetic electron from an inner-shell structure of an atom almost instantaneously induces the bound-to-free transition of another neighboring electron while the filling of an inner-shell vacancy of an atom. This phenomenon is known as Auger effect. In this process, the filling of an inner-shell vacancy of an atom also emanates a few keV level X-rays which is generally known as X-ray fluorescence or Bremsstrahlung. An energized beta particle has almost the same effect on an atom as a high energy photon. A beta particle with MeV level energy (i.e., Strontium-90) has the ability to shake up the nucleus of an atom by collision. In such a case, an emission of y-rays is anticipated and has a subsequent interactive phenomenon with neighboring atoms. The pn process is as complex as the pe process. High energy photons can directly couple with a nucleus. In such a coupling case, nucleus can undergo a level reordering process under an unstable resonant mode if the photon energy is lower than the binding energy of the nucleus. Unstable resonant modes of a nucleus can generate a variation in centroid energy levels of nuclei that affects the stability of valence shell electrons. In some cases, the level reordering process may cause a majority of photon energy to create a pair production near a nucleus, such as an electron and a positron, a muon and an anti-muon, or a proton and an antiproton. The photon energy level of the interaction must be above a certain threshold to create the pair which is at least the total rest mass energy of the two particles. To conserve both energy and momentum, the photon energy is converted to particle's mass or vice versa. The rest mass energies of an electron and a positron are 1.022 MeV. Therefore, the minimum photon energy level to create an electron-positron pair is 1.022 MeV. Any photon energy level higher than 1.022 MeV can increase the rate of pair production. As discussed above, when pair production occurs, the nucleus undergoes a mode change with a recoiling process. Accordingly, the annihilation process of electron/positron generates y-rays at 1.022 MeV. The resulting y-rays at 1.022 MeV have a significant detrimental effect on subsequent interactions with shell-electrons of its own or neighboring atoms.

Compton scattering (Cs) is a physical phenomenon that describes the scattering of a photon with a charged particle, similar to an electron. When a charged particle is coupled with high energy photon, a charged particle gains energy from the incident photon while the photon energy, after scattering, is reduced by the same amount of energy gained by a charged particle. When an electron is affected by Compton scattering with y-rays, the energy level gained by the electron is substantial and accelerates the electron with the kinetic energy in keV level. The remaining energy is still carried by the photon. The energies carried by an electron and a photon after scattering remain so high that they have consequential effects on higher order interactions.

The coupling processes, such as pe, pn, Cs, and pp, occur when an emitter material receives high energy photons and high energy beta particles. But these coupling processes also take place within its own emitting body structure of the radioisotope that emits gamma rays and/or beta particles. Certain radioisotopes, such as Co-60 (see FIG. 2), have not only the emission spectra of beta decay and high energy photons, but the beta particles and high energy photons are actively coupled with their own isotopic atoms within the body material to further yield the Compton-edge electrons, Bremsstrahlung, Auger electrons, and pair production through the primary, secondary, tertiary, etc., interactions.

Figure 2:
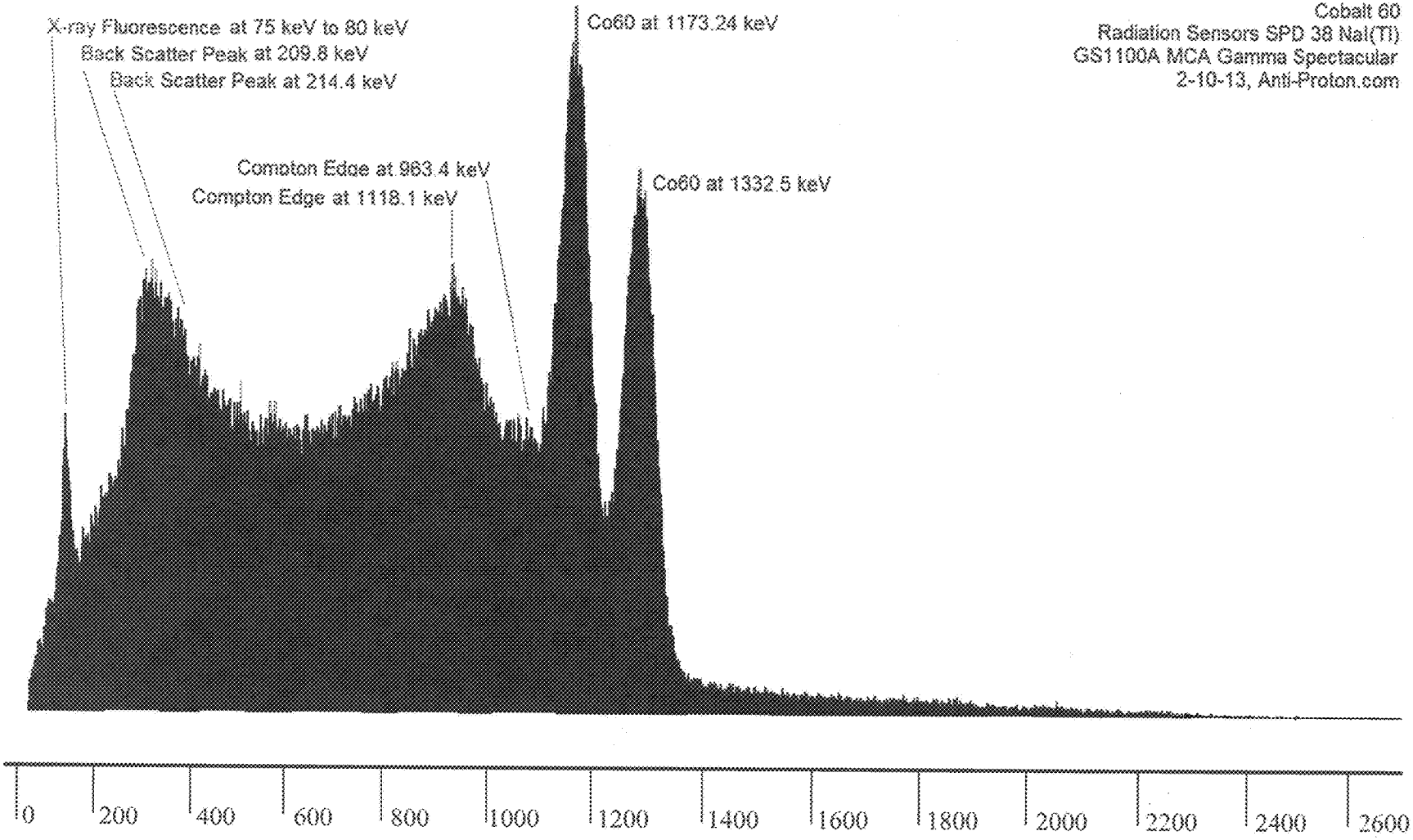
FIG. 2 depicts the emission spectra from Cobalt 60 as disclosed herein.

As shown in FIG. 2, the spectral distribution of emission, except for the two major peaks at 1173.24 keV and 1332.5 keV, is attributed to the complex internal interaction processes identified as the Compton-edge electrons, Bremsstrahlung, Auger electrons, and pair production. Such emission patterns from the isotope itself can be also beneficial and used for power generation if a different NTAC device is designed to subsidize the additional photon energy. As such a newly designed NTAC will have increased performance if constructed with the radioisotope distributed in thin layers.

Figure 3:
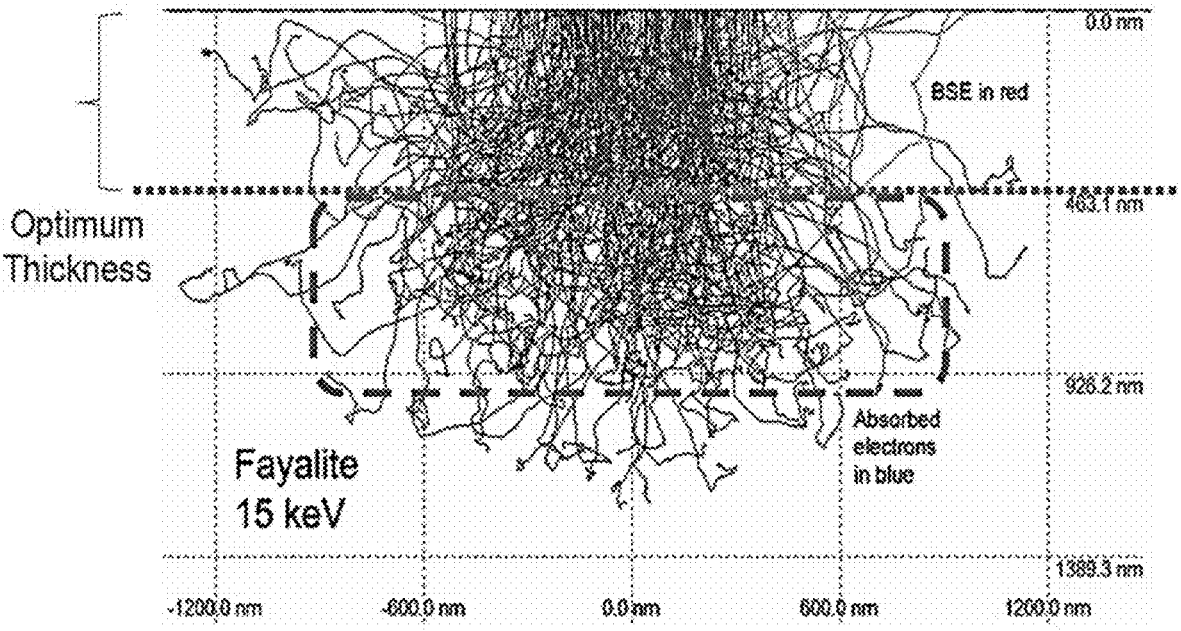
FIG. 3 depicts a simulation model of back-scattered electrons and multiplication of scattered electrons while 15 keV X-ray is incident on Fayalite as disclosed herein.

The attenuation of high energy photons through a material usually follows the Beer-Lambert law. The transmittance of photons through a medium is described by:

$$T=e-\sigma\cdot\rho\cdot z$$

where σ is the attenuation cross-section of a medium, ρ the density of a medium, and z the path length of the beam of light through a medium. The transmittance of high energy photons can be lowered as the cross section is large, or density is high, or the path length is long, or by all together. The cross section and density, however, are mainly determined by morphological formation of material. The only control parameter for the absorption of high energy photons is the thickness of material. Specifically, for NTAC applications, the thickness of a selected material cannot be increased only to improve the absorption of high energy photons. If a material is made too thick in an effort to absorb more high energy photons, the electrons liberated from the intra-band of atoms located deep inside the material by high energy photons cannot be readily emitted out of the domain of material due to the loss of energy through multiple scatterings through the Coulomb collisions. The distance of electron passage without scattering is determined by the mean-free path. If the passage length is too thick, the photo-ionic process is quenched and the liberated energetic electrons are thermalized and eventually undergo a recombination process. As shown in FIG. 3, when Fayalite is illuminated by a 15 keV electron beam, the back-scattered electrons are emitted from the domain of material. The multiply scattered electrons remain within the domain and lose their kinetic energy by sequential Coulomb collisions, and are eventually recombined into the atomic structure. To maximize the photo-ionic emission process through which a number of photo-excited electrons are released and emitted from emitter material, an optimal thickness of material can be estimated using a simulation model. For Fayalite shown in FIG. 3, as an example, the optimum thickness for the maximum emission of liberated electrons is approximately a thickness of 463.1 nm under the impingement of 15 keV electron beam. A huge number of electrons can be emitted out from the back surface of Fayalite if 15 keV electron beam is incident on a 463.1 nm thick Fayalite. The estimation of optimum thickness can be made with Monte Carlo simulation code whose open source code is available in public domain. In some materials, the optimum thickness may be much thicker than 463 nm of Fayalite. In some other examples, the optimum thickness may be less than 463 nm. In some examples, the optimum thickness of ordered structural materials may vary from about micrometer scale to millimeter scale. In some other examples of largely disordered high Z materials, the optimum thickness may be much smaller than 463 nm of Fayalite, such as 200 nm, 300 nm, or 400 nm. Even if a flux of high energy photons (keV to MeV level) is incident on a material, there will be emissions of Auger and Compton electrons after the primary interaction of high energy photons with the inter-atomic structure. Such Auger and Compton electrons carry several tens to hundreds of keV energy and eventually interact with and liberate much more additional number of multiple electrons as shown in FIG. 3. Accordingly, it is beneficial to keep the thickness of emitter material thin in order to have additional avalanche emission of electrons tossed off after Coulomb collisions with high energy Auger and Compton electrons.

Figure 4:
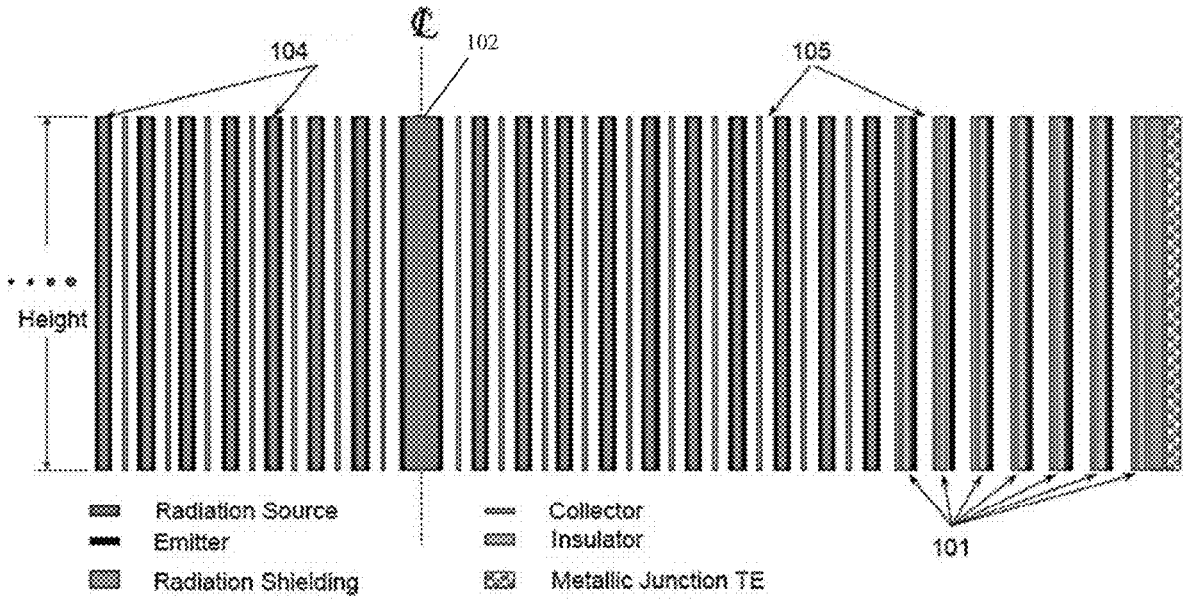
FIG. 4 illustrates a cross-section view of an NTAC device with distributed thin radioisotope layers, in accordance with one or more embodiments.

FIG. 4 depicts a cross-section of the newly designed nuclear thermionic avalanche cells of FIG. 1 that maximize the liberation of electrons from emitters by adopting distributed thin isotope layers along with NTAC layers 101 and separated by vacuum gaps 105. The number of layers can be determined by the requirement of power output. The core element 102 and thin layers of radioisotope 104 that emit y-rays and/or beta particles are co-axially arranged with radial increments shown on the left side of FIG. 4. Both sides of each radioisotope source 102 and 104 are wrapped by thin emitter layers (electrode) (shown as 114 in FIG. 5) that capture high energy photon fluxes from a radioisotope layer 102 and 104 for the liberation of intra-band electrons. There are collectors (shown as 112 in FIG. 5) positioned between the thin radioisotope layers 104 and core 102 wrapped with the emitters 114 on both sides. The collectors 112 receive electrons released and crossed over the vacuum gap from emitters. The collector 112 itself also receives and couples with incident y-ray radiation and energetic electrons that might cause the electrons to be liberated from collector material too. A nanostructured emitting surface of high Z-material which has a large number of electrons within the shell structure of atom is selected for emitter 114, while the collector material 112 can be selected from a low or a mid Z material. Therefore, the number of liberated electrons from the emitter 114 arriving at the collector 112 overwhelms the liberated electrons from the collector. This phenomenon is illustrated shown in FIG. 5.

Figure 5:
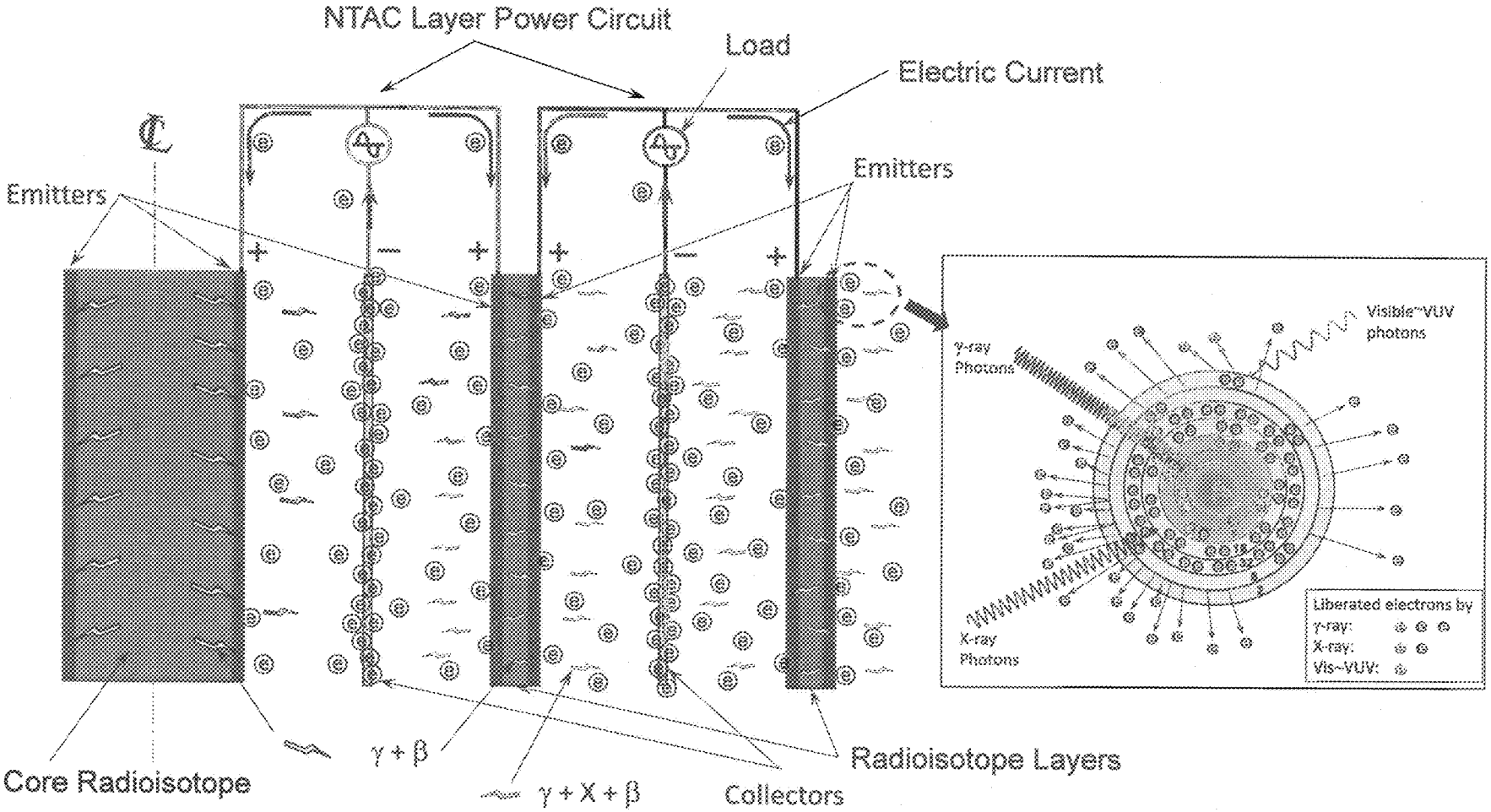
FIG. 5 illustrates how electrons are liberated from emitter materials cross over the vacuum gap and arrive at the collector surface, in accordance with one or more embodiments of the present disclosure.

FIG. 5 illustrates liberation of electrons from an emitter material to a collector surface. A large number of electrons liberated from emitter materials 114 are emitted from the nanostructured surface of emitter 114 and cross over the vacuum gap 105 and arrive at the collector surface 112. By the direct impingement of high energy photons, such as y-ray transmitted through the emitter, X-ray fluorescence and the residue y-ray as a remainder of Compton scattering, the collector 112 itself also undergoes liberating inner-shell electrons from the collector material. However, the number of energetic electrons arriving from emitters 114 at collectors 112 overwhelms the number of liberated electrons from collector. By forming a closed circuit between the emitter and the collector, the NTAC layer power circuit 200 harnesses these supplant electrons from the collector to a load 202. The lightning symbol 201 depicted in FIG. 5 indicates the emission of y-ray and/or high energy beta particles from the core 102 and layers 104 of radioisotope. The emission symbol 203 indicates the emission streams of y-ray, X-ray, and energetic electrons from the emitter materials 114 after the high order interactions and also partially from the core 102 and layers 104 of radioisotope. This emission stream 203 will interact with the material in the next layer. The details of interaction is shown in the FIG. 5 inset of which a pattern of electron transition from bound to free is depicted with the incident photon energy. FIG. 5 also depicts the generation of current 204 in the power circuit 200 formed between the emitters 114 and collectors 112.

Figure 6:
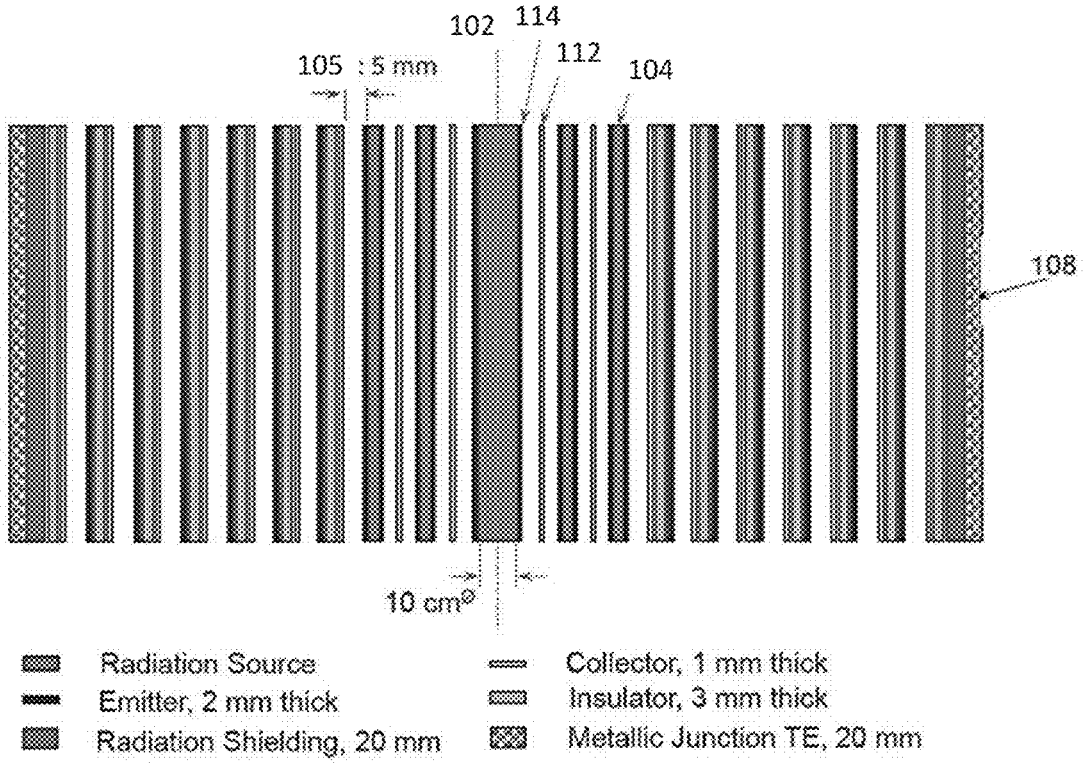
FIG. 6 illustrates the cross-section view of an NTAC device with two distributed thin radioisotope layers and seven NTAC layers, in accordance with one of more embodiments.

FIG. 6 illustrates the cross-section view of an NTAC device with two distributed thin radioisotope layers and seven NTAC layers. In some embodiments, the number of NTAC layers maybe more or lower than 7 which will be determined by the kind of radioisotope and the thickness of emitter, insulator, and collectors. The device shown in FIG. 6 was used as a model to simulate the system performance for 20 kW or higher power output. This model includes an extra radiation shielding layer and a layer for thermal energy conversion using the metallic junction thermoelectric efficiency (MJTE) device 108 in a radial direction. The top and bottom caps of NTAC have radiation shielding layers and metallic junction thermoelectric devices. The radiation source comprises the core 102 and two separate layers 104. The system simulation model uses gadolinium (Gd) as an emitter material, copper as a collector, and quartz as an insulator as indicated in below Table I. Based on the results of theoretical study shown in Table I, the system only requires five layers of NTAC to absorb and convert the photon power delivered from the radioisotope core 102 and two radioisotope layers 104. A system with at least five layers of NTAC absorbs all radiation and converts it into useful power and thermal loading. Thus, there is no residual radiation that can escape the system. As an additional radiation protection, however, the system includes a blanket of lead with a 1 cm thickness. An additional layer that is a metallic junction with 1.5 cm thickness can also provide radiation shielding. There are vacuum gaps 105 between layers where the liberated electrons cross over. Some of initial photon energy can be converted to thermal energy after photon-scattering through the layer materials and also thermal energy comes from when those freed electrons undergo inelastic scattering with neighboring electrons of atom. A portion of this thermal loading on each layer is conducted out through the emitter and conductor materials in an axial direction. The remaining thermal loading crosses over the vacuum gap by radiative transfer. Because of cylindrical formation of the NTAC layers 101 with narrow vacuum gaps 105, a significant portion of thermal energy can be transmitted in a radial direction through the layers of vacuum gaps 105 and NTAC layers 101 and eventually arrive at the metallic junction layer 108. Thermal energy transferred through both the axial and radial directions is converted by MJTE device 108. In the simulation, only 10% of MJTE efficiency was used to capture and convert thermal energy. Based on the simulation study conducted for the MJTE device with the 10 layers ($10^8$ junctions/layer, 50 μm layer thickness) for the temperature difference between 273° K and 1273° K, the efficiency turns is about 20%. Including the spacer and crossbeam for 10 layers, the actual thickness of MJTE simulation model was 0.7 mm. If the thickness of MJTE device is increased by adding a number of layers more than the 10 layers used for the same temperature difference, the efficiency will be much higher than 20%. The efficiency of 10% selected for the NTAC simulation is a conservative value.

TABLE I

NTAC configuration with selections of emitter, collector, and insulator.

| Photon Energy | Layer 1 | | | | | | | | | | | | | | | | | | | | | | NTAC |
|---|---|---|---|---|---|---|---|---|---|---|---|---|---|---|---|---|---|---|---|---|---|---|---|
| (MeV) | Emitter | Collector | Insulator | Emitter | Layer 2 | | | Layer 3 | | | Layer 4 | | | Layer 5 | | | Layer 6 | | | Layer 7 | | | Layer # |
| | La | Cu | $SiO_2$ | La | | | | | | | | | | | | | | | | | | | |
| 0.6 | 0.1399 | 0.0648 | 0.0619 | 0.1399 | X | X | X | X | X | X | X | X | X | | | | | | | | | | 4 |
| 1.25 | 0.0885 | 0.0958 | 0.0442 | 0.0885 | X | X | X | X | X | X | X | X | X | X | X | X | X | X | X | | | | 6 |
| 7 | 0.0680 | 0.0272 | 0.0209 | 0.0680 | X | X | X | X | X | X | X | X | X | X | X | X | X | X | X | X | X | X | 8 (3%) |
| | Ga | Cu | $SiO_2$ | Ga | | | | | | | | | | | | | | | | | | | |
| 0.6 | 0.1893 | 0.0648 | 0.0619 | 0.1893 | X | X | X | X | X | X | | | | | | | | | | | | | 3 |
| 1.25 | 0.1147 | 0.0458 | 0.0442 | 0.1147 | X | X | X | X | X | X | X | X | X | X | X | X | | | | | | | 5 |
| 7 | 0.0911 | 0.0272 | 0.0209 | 0.0911 | X | X | X | X | X | X | X | X | X | X | X | X | X | X | X | X | X | X | 7 |
| | Re | Cu | $SiO_2$ | Re | | | | | | | | | | | | | | | | | | | |
| 0.6 | 0.4826 | 0.0648 | 0.0619 | 0.4826 | | | | | | | | | | | | | | | | | | | 1 |
| 1.25 | 0.2914 | 0.0458 | 0.0442 | 0.2914 | X | X | X | | | | | | | | | | | | | | | | 2 |
| 7 | 0.2408 | 0.0272 | 0.0209 | 0.2408 | X | X | X | X | X | X | | | | | | | | | | | | | 3 |
| | Au | Cu | $SiO_2$ | Au | | | | | | | | | | | | | | | | | | | |
| 0.6 | 0.4769 | 0.0648 | 0.0619 | 0.4769 | | | | | | | | | | | | | | | | | | | 1 |
| 1.25 | 0.2777 | 0.0458 | 0.0442 | 0.2777 | X | X | X | | | | | | | | | | | | | | | | 2 |
| 7 | 0.2289 | 0.0272 | 0.0209 | 0.2289 | X | X | X | X | X | X | | | | | | | | | | | | | 3 |

Figure 7:
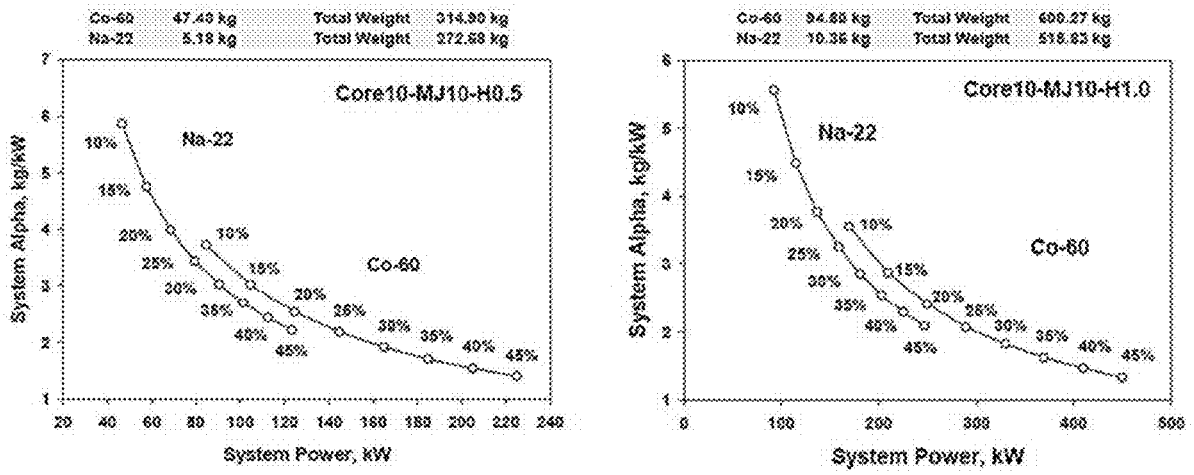
FIG. 7 depicts a graphical representation of the simulation results of NTAC with the fixed volume (0.00217 $m^3$) of radiation source and seven NTAC layers as disclosed herein.

FIG. 7 shows the simulation results of the NTAC which was made with a fixed volume (0.00217 $m^3$) of radioactive materials. The total number of NTAC layers used for this model was seven layers. The required number of NTAC layers needed to absorb and convert the incident y-ray radiation is only five as indicated in Table I. Based on the theoretical calculation made for the 1.25 MeV y-ray radiation, the five layers of Cu-quartz-Gd completely absorb the radiation with no radiation leaks. The graph on the left of FIG. 7 displays the specific weights of Na-22 and Co-60 cases for a radiation core diameter of 10 cm and a height of 50 cm along with system power. The graph on the right of FIG. 7 is for a radiation core diameter of 10 cm and the height of 100 cm along with system power. Due to the low density of Na-22, the actual mass of Na-22 used for calculations is only 5.18 kg vs. 47.4 kg of Co-60.

Figure 8:
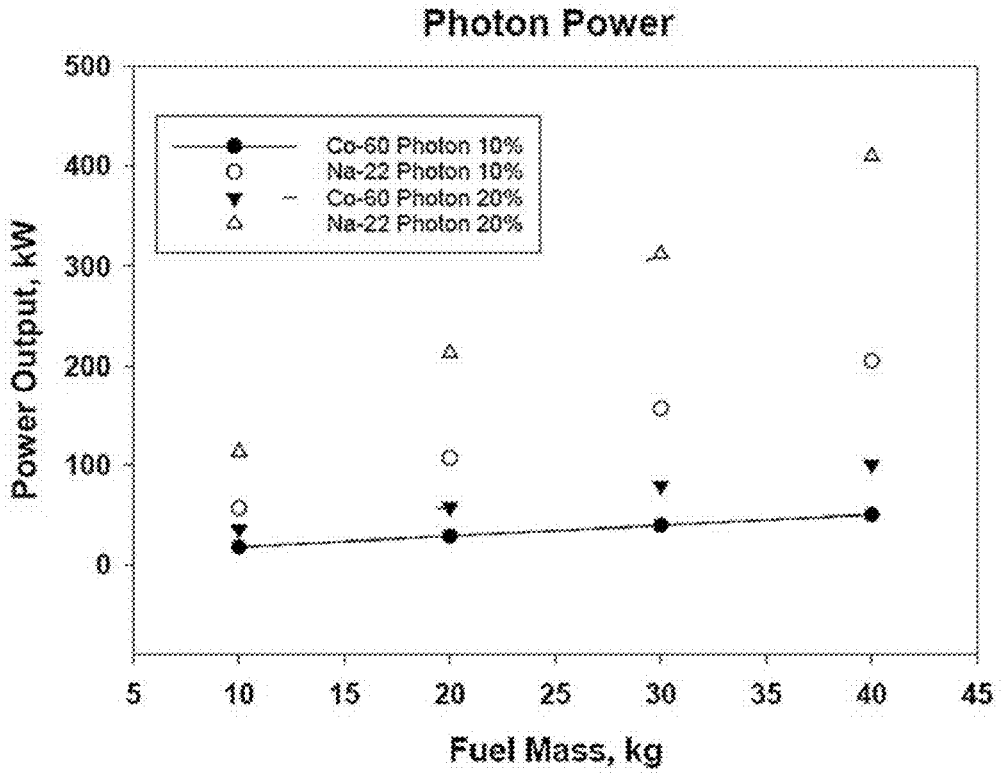
FIG. 8 graphically depicts the power output based on the radioisotope weight as disclosed herein.

FIG. 8 shows the power output of an improved NTAC based on the weight of radioisotope used. The plots were made for the photon power conversion efficiencies, 10% and 20%, for Co-60 and Na-22 while keeping 10% for MJTE efficiency. It is quite noticeable that 40 kg of a Na-22 NTAC system has a 400 kW power potential which is at least four times greater than that of Co-60 with the same fuel mass.

Figure 9:
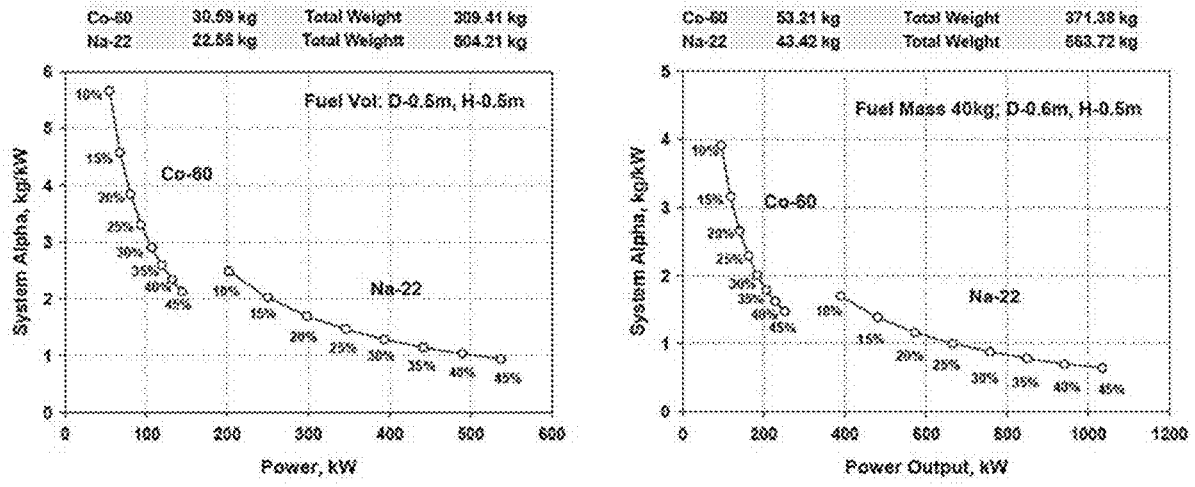
FIG. 9 graphically depicts the simulation results of NTAC with the fixed fuel masses (approx. 20 kg and 40 kg) of radiation source and with seven NTAC layers as disclosed herein.

FIG. 9 shows the specific weight for the fixed fuel mass. The left graph of FIG. 9 shows the specific weights of the NTAC with the fuel weights of 30.5 kg of Co-60 and 22.56 kg of Na-22, respectively. The right graph of FIG. 9 shows the specific weights for the fuel weights of 53.21 kg of Co-60 and 43.42 kg of Na-22, respectively.

Specific elements of any of the foregoing embodiments, implementations, or examples can be combined or substituted for elements in other embodiments or examples. Furthermore, while advantages associated with certain embodiments and examples of the disclosure have been described in the context of these embodiments, other embodiments and examples may also exhibit such advantages, and not all embodiments need necessarily exhibit such advantages to fall within the scope of the disclosure.

What is claimed is:

1. A nuclear thermionic avalanche cell (NTAC) system comprising:

a radioisotope core comprised of a nuclear radioisotope material, wherein the radioisotope core is surrounded by a core thin emitter layer comprising an emitter material;

a plurality of radioisotope source layers, the radioisotope core and the plurality of radioisotope source layers configured to emit energetic beta particles and high energy photons, wherein each of the plurality of radioisotope source layers comprise:

an inner thin emitter layer, the inner thin emitter layer comprising the emitter material;

an outer thin emitter layer, the outer thin emitter layer comprising the emitter material; and a radiation source layer comprised of the nuclear radioisotope material, the radiation source layer disposed between the inner thin emitter layer and the outer thin emitter layer such that the radiation source layer surrounds the inner thin emitter layer and the outer thin emitter layer surrounds the radiation source layer, wherein the plurality of radioisotope source layers are arranged concentrically around the radioisotope core such that a plurality of vacuum gaps are created where one of the plurality of vacuum gaps is created between an inner most one of the plurality of radioisotope layers and the radioisotope core and each remaining of the plurality of vacuum gaps is created between pairs of the plurality of radioisotope layers;

a plurality of collectors comprised of a collector material, one of the plurality of collectors disposed in each of the plurality of vacuum gaps, the plurality of collectors spaced within each of their respective ones of the plurality of vacuum gaps so as to not contact the radioisotope core or radioisotope source layers; and a plurality of NTAC layers integrated with the radioisotope core and the radioisotope source layers, the plurality of NTAC layers each having at least one NTAC emitter layer comprising the emitter material, wherein:

the plurality of NTAC layers are configured to receive the energetic beta particles and the high energy photons, and by the received energetic beta particles and the high energy photons free up electrons to an avalanche process from deep and intra bands of atoms of the emitter material to output thermal energy through a photo-ionic or thermionic process of the freed up electrons; and the plurality of NTAC layers are arranged concentrically around the radioisotope core and the plurality of radioisotope layers such that the plurality of radioisotope layers are disposed between the radioisotope core and the plurality of NTAC layers.

2. The system of claim 1, wherein the energetic beta particles are electrons or positrons.

3. The system of claim 1, wherein the high energy photons are x-rays, gamma rays, or UV light.

4. The system of claim 1, wherein the nuclear radioisotope material is Cobalt-60, Sodium-22, or Cesium-137.

5. The system of claim 1, wherein the core thin emitter layer, the inner thin emitter layers, and the outer thin emitter layers are configured to capture and interact with the energetic beta particles and the high energy photons released from the radioisotope core and the plurality of radioisotope source layers.

6. The system of claim 5, wherein the emitter material comprises a nanostructured surface of a high Z material.

7. The system of claim 6, wherein the plurality of collectors are configured to capture the energetic beta particles and/or the high energy photons emitted from the core thin emitter layer, the inner thin emitter layers, and the outer thin emitter layers, and wherein the plurality of NTAC layers is a number of NTAC layers selected such that all photon energy is depleted to a zero level without escaping the plurality of NTAC layers.

8. The system of claim 7, wherein the collector material comprises a low or mid Z material.

9. The system of claim 1, wherein each of the plurality of radioisotope source layers have a thickness from about 3 mm to about 5 mm.

10. The system of claim 9, wherein the plurality of radioisotope source layers is two radioisotope source layers, the plurality of NTAC layers is five NTAC layers, the emitter material is gadolinium or a high Z material, and the collector material is copper.

11. The system of claim 1, further comprising:

a metallic junction layer arranged around a NTAC layer of the plurality of NTAC layers farthest from the radioisotope core such that the plurality of NTAC layers are disposed between the plurality of radioisotope layers and the metallic junction layer;

a top cap; and a bottom cap, the top cap and the bottom cap including radiation shielding layers and the tope cap and the bottom cap arranged to interface with the metallic junction layer such that the top cap, the bottom cap, and the metallic junction layer together encase the radioisotope core, the plurality of radioisotope layers, the plurality of collectors, and the plurality of NTAC layers, wherein a metallic junction thermoelectric generator is configured to receive the output thermal energy from the plurality of NTAC layers via the metallic junction layer and output thermoelectric power.

* * * * *